US008161960B2

(12) United States Patent
Yi

(10) Patent No.: US 8,161,960 B2
(45) Date of Patent: Apr. 24, 2012

(54) BUILT-IN COOKING APPLIANCE

(75) Inventor: Soo Cheol Yi, Changwon (KR)

(73) Assignee: LG Electronics Inc., Seoul (KR)

( * ) Notice: Subject to any disclaimer, the term of this patent is extended or adjusted under 35 U.S.C. 154(b) by 208 days.

(21) Appl. No.: 12/448,802

(22) PCT Filed: Nov. 15, 2007

(86) PCT No.: PCT/KR2007/005750
§ 371 (c)(1),
(2), (4) Date: Jan. 4, 2010

(87) PCT Pub. No.: WO2008/084914
PCT Pub. Date: Jul. 17, 2008

(65) Prior Publication Data

US 2010/0101554 A1 Apr. 29, 2010

(30) Foreign Application Priority Data

Jan. 9, 2007 (KR) ..... 10-2007-0002375
Jan. 9, 2007 (KR) ..... 10-2007-0002378
Jan. 9, 2007 (KR) ..... 10-2007-0002549

(51) Int. Cl.
*F24C 15/10* (2006.01)

(52) U.S. Cl. ..... 126/214 A; 126/37 A; 126/39 K

(58) Field of Classification Search ..... 126/214 A, 126/39 H, 37 A, 39 K, 1 R, 211; 219/623, 219/452.12; D7/367
See application file for complete search history.

(56) References Cited

U.S. PATENT DOCUMENTS

2006/0144388 A1* 7/2006 Hosoi et al. ..... 126/214 A

FOREIGN PATENT DOCUMENTS

| | | |
|---|---|---|
| JP | 3122990 | 12/1991 |
| JP | 02-690156 B2 | 12/1997 |
| JP | 2005-265209 A | 9/2005 |
| JP | 2005265209 | 9/2005 |
| JP | 2006-322645 A | 11/2006 |

* cited by examiner

*Primary Examiner* — Alfred Basichas
(74) *Attorney, Agent, or Firm* — McKenna Long & Aldridge LLP

(57) ABSTRACT

A built-in cooking appliance includes a top plate, a body frame provided under the top plate and receiving a heat source, a cabinet supporting the body frame and spaced apart from at least one side of the top plate, a support having a first side connected to the cabinet and a second side supporting a top surface of the top plate, a top frame covering a space between the top plate and the cabinet, and an airflow openings formed on the support and the top frame.

21 Claims, 6 Drawing Sheets

[Fig. 1]
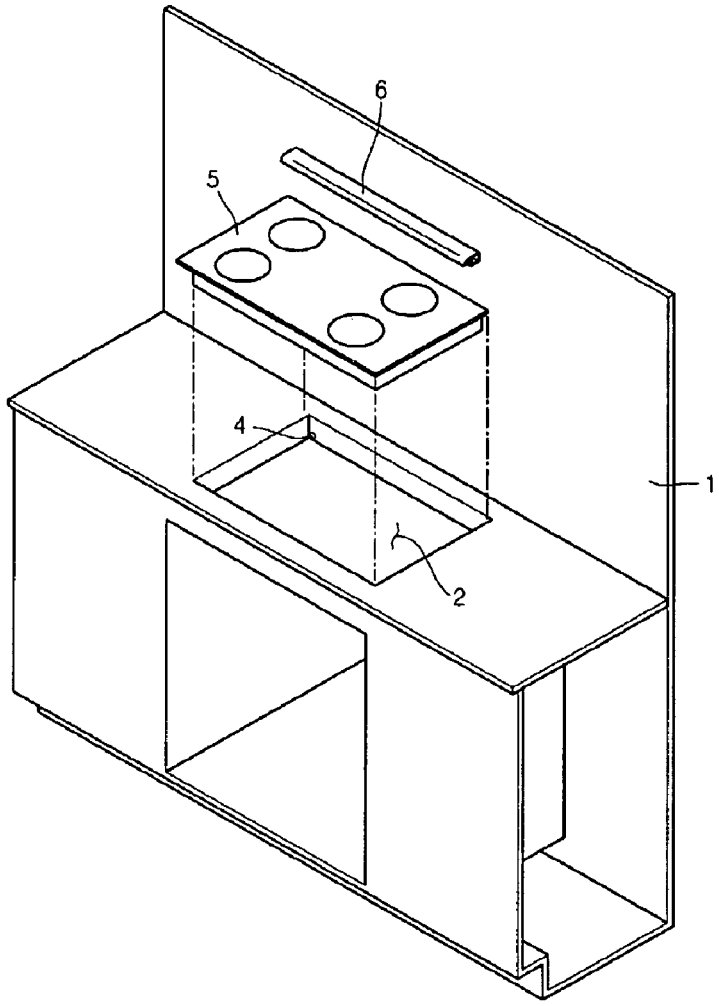
[Fig. 2]
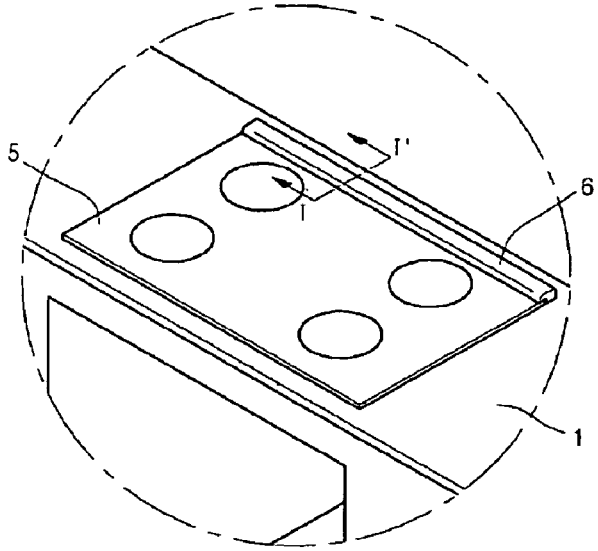

[Fig. 3]
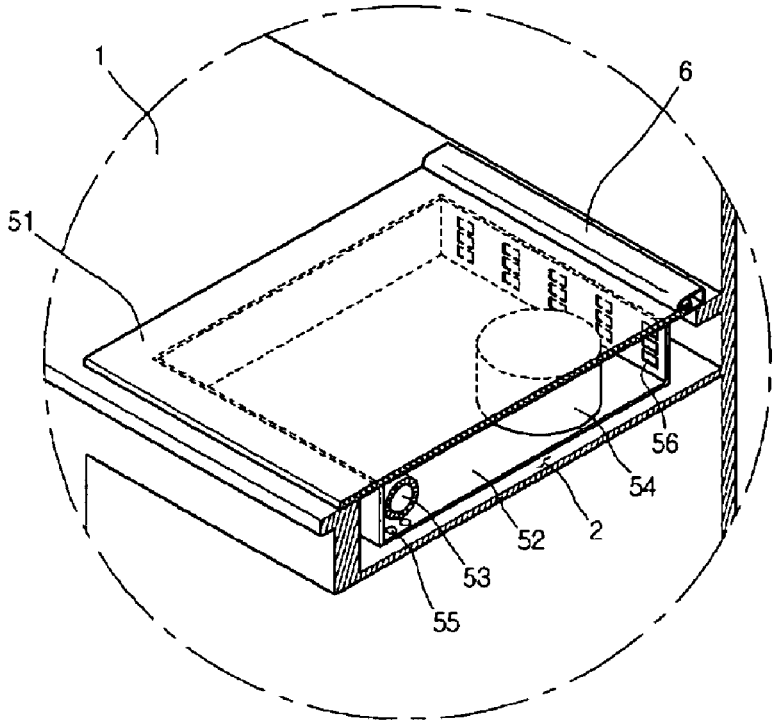
[Fig. 4]
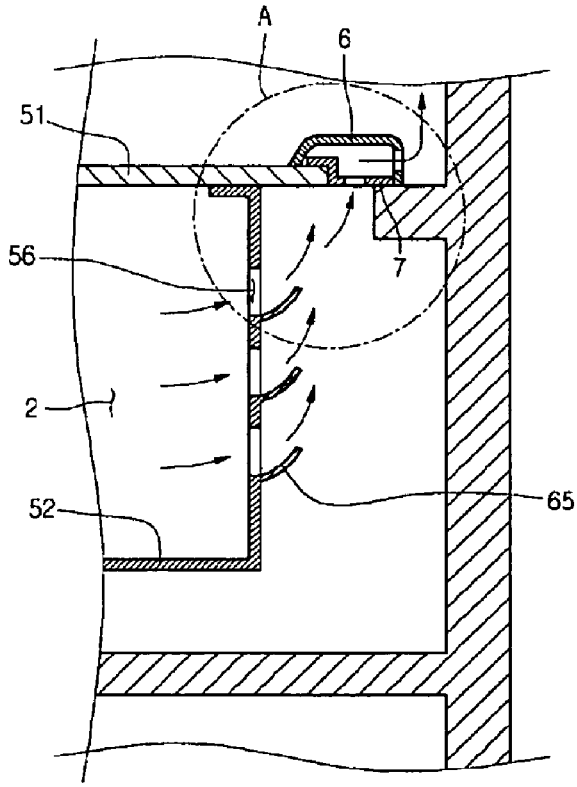

[Fig. 5]
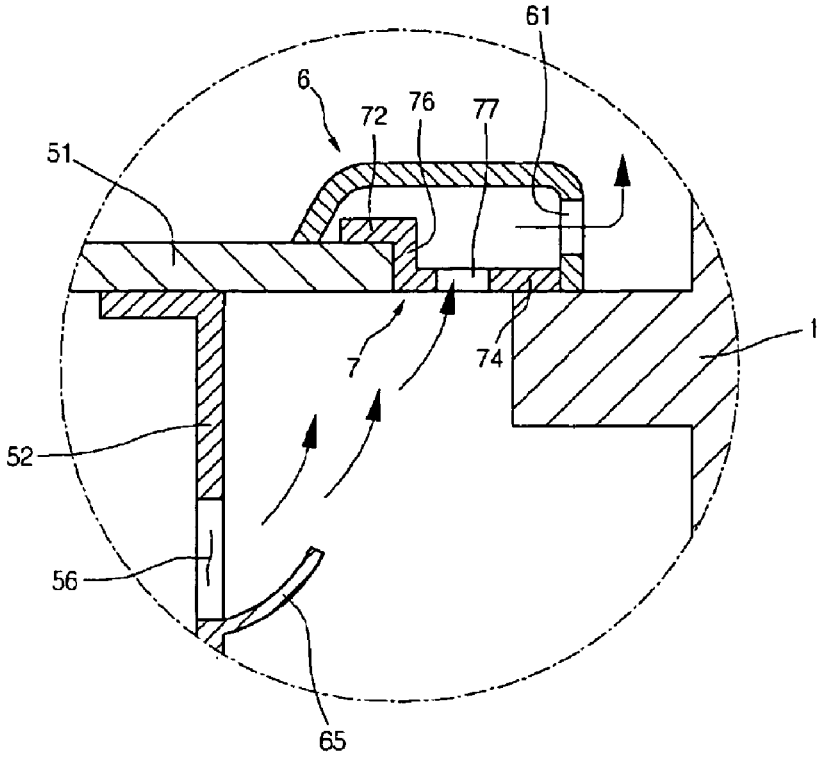
[Fig. 6]
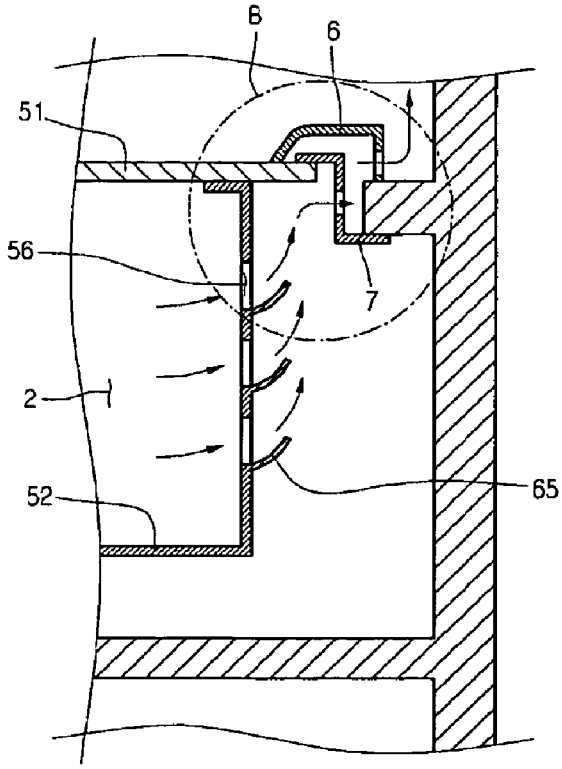

[Fig. 7]
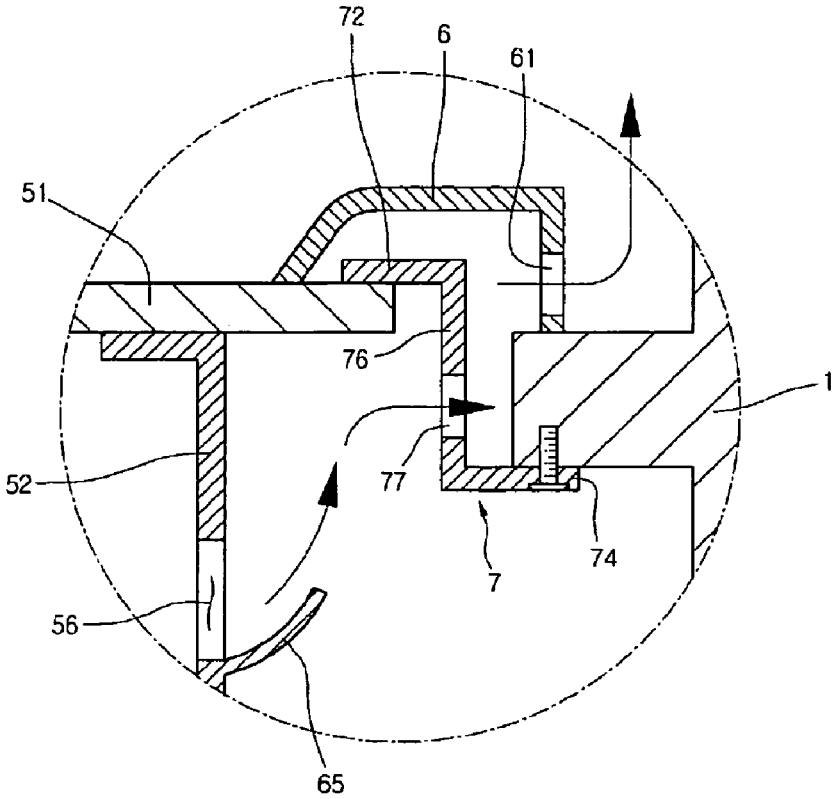
[Fig. 8]
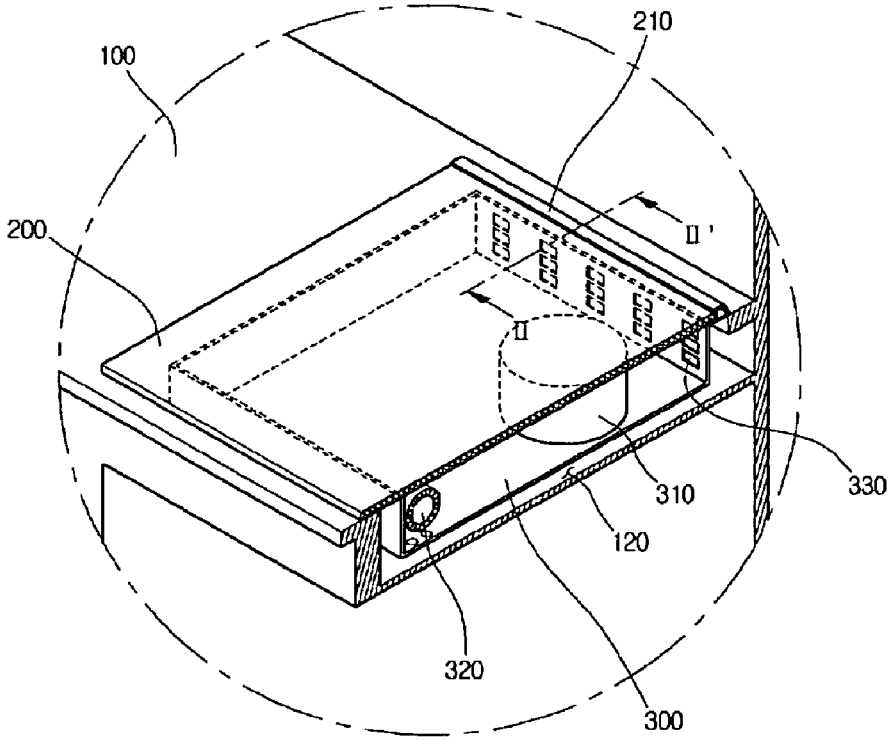

[Fig. 9]
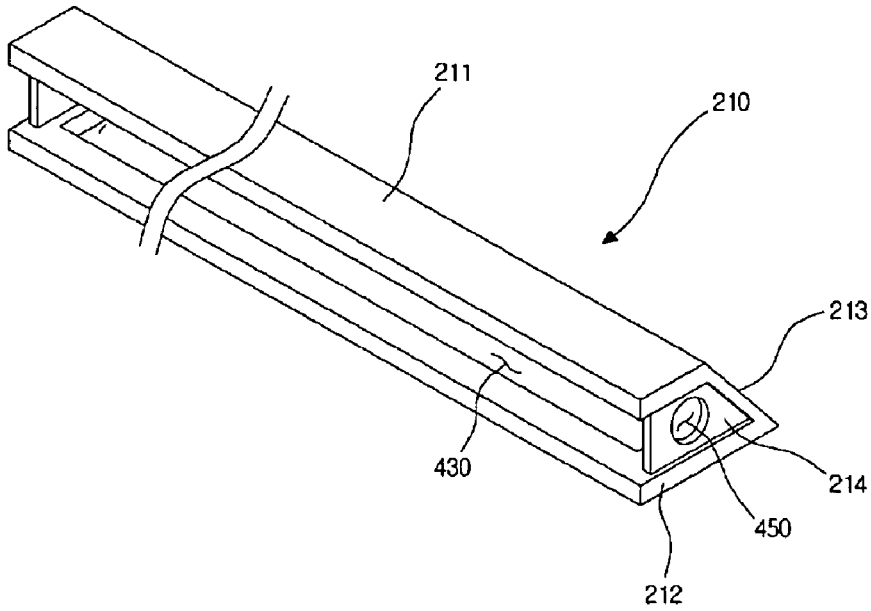
[Fig. 10]
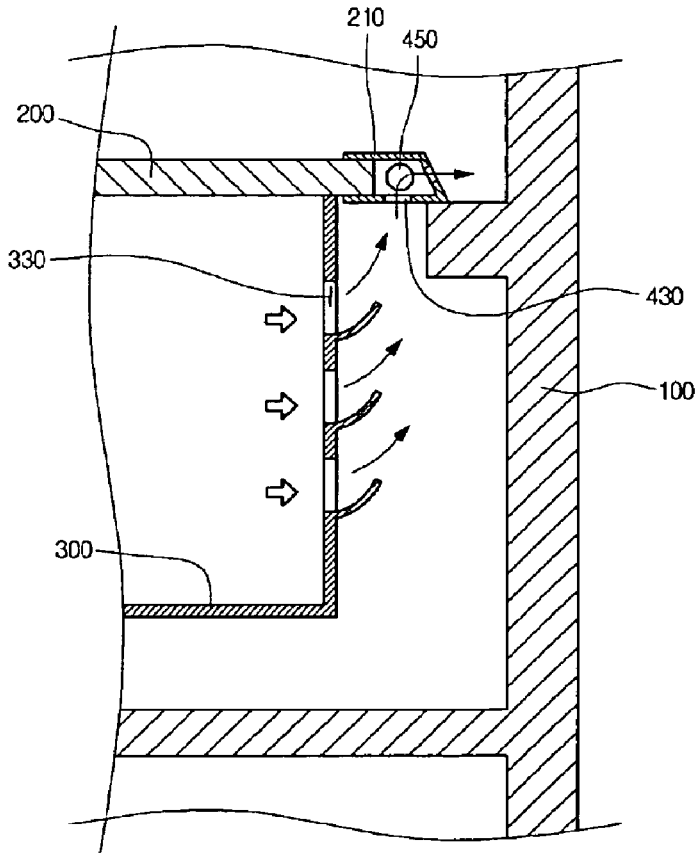

[Fig. 11]
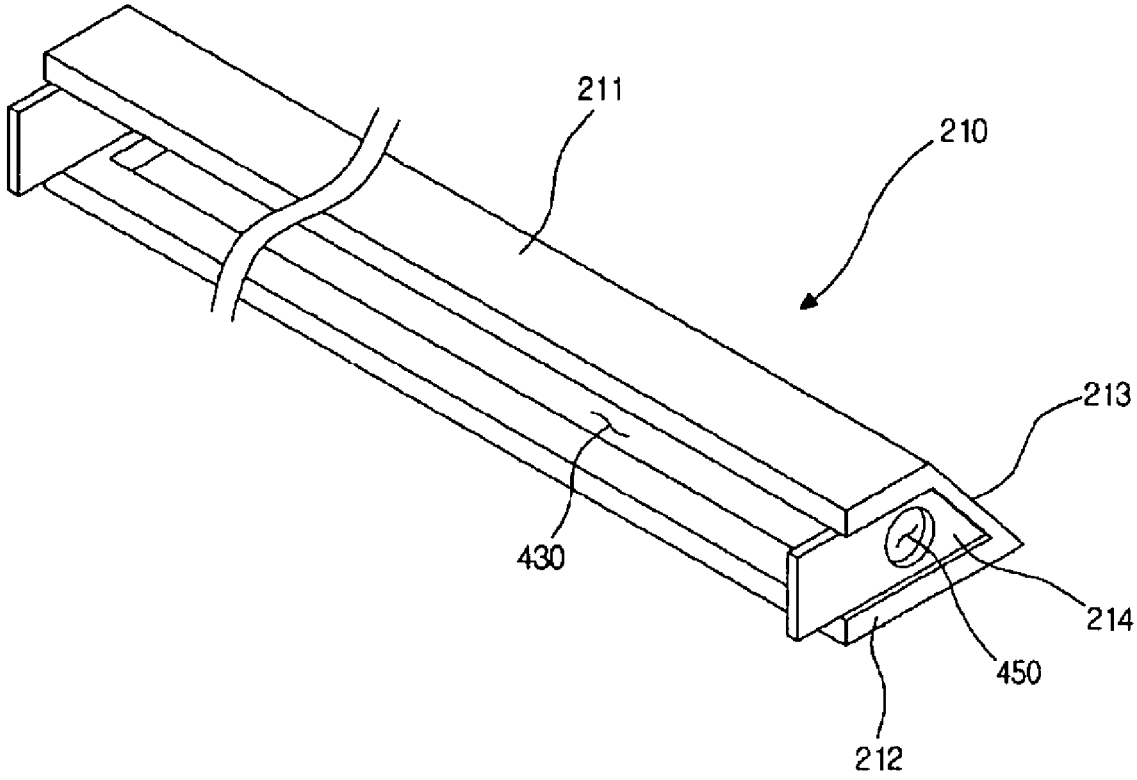

BUILT-IN COOKING APPLIANCE

This application is a 35 U.S.C. §371 National Stage entry of International Application No. PCT/KR2007/005750, filed on Nov. 15, 2007, and claims priority to Korean Application Nos. 10-2007-0002375; 10-2007-0002378; 10-2007-0002549, all filed on Jan. 9, 2007, which are all hereby incorporated by reference in their entireties.

TECHNICAL FIELD

This document relates to a built-in cooking appliance and, more particularly, to a built-in cooking appliance having a top plate on which food is cooked.

BACKGROUND ART

A built-in cooking appliance is a kitchen appliance installed on a cabinet. That is, the built-in cooking appliance is associated with kitchen furniture so that a user can conveniently use the same. The built-in cooking appliance makes the interior of the kitchen beautiful.

In recent years, a built-in cooking appliance having a top plate, which can cook the food using heat transmitted to the food through the top plate, has been developed. Such a built-in cooking appliance having the top plate is called a hot plate, a hob, a range, or a cook-top. Regardless of the name, a concept of the present invention may be applied to any cooking appliances having the top plate. In the following description, a terminology cooking appliance means a cooker having the top plate.

In order to operate components under a thermally-stable state, a typical cooking appliance is designed such that air flows in and out of the cooking appliance. To realize this, the top plate is mounted protruding above the top surface of the top plate by a predetermined height. In this case, it is difficult to clean a portion around the top plate and an outer appearance is deteriorated.

*In the typical cooking appliance, water may flow into a main body of the cooking appliance through an air passage hole formed on the top plate or a portion around the top plate. The water flowing into the main body of the cooking appliance may cause a short circuit or malfunction of the cooking appliance. This problem must be most considered in designing the cooking appliance as the cooking appliance is used in the kitchen where the water is frequently used.

Further, since the cooking appliance is designed to cook food in a state where a dishware such as a cook pot is disposed on a flat surface of the top plate, the dishware must be stably secured on the flat surface. However, although a location where the dishware will be located is graphically marked on the top plate, the cooking appliance does not have any means for physically securing the dishware on the top plate. Therefore, when the top plate is slippery due to, for example, oil, the dishware disposed on the top surface of the top plate may inadvertently move to an undesired location. The dishware falls down from the top plate to pore the food out of the dishware.

DISCLOSURE OF INVENTION

Technical Problem

Embodiments provide a built-in cooking appliance that is configured to effectively cool an inside of the cooking appliance and minimize a protruding height of the cooking appliance from a cabinet.

Embodiments also provide a built-in cooking appliance that is configured to reduce possibility that water flows into the cooking appliance and be used by a user with safety.

Technical Solution

In one embodiment, a built-in cooking appliance includes a top plate; a body frame provided under the top plate and receiving a heat source; a cabinet supporting the body frame and spaced apart from at least one side of the top plate; a support having a first side connected to the cabinet and a second side supporting a top surface of the top plate; a top frame covering a space between the top plate and the cabinet; and an airflow openings formed on the support and the top frame.

In another embodiment, a built-in cooking appliance includes a body frame receiving a heat source; a top plate provided above the body frame; a cabinet supporting the top plate; and a support connecting the top plate to the cabinet and provided with an airflow opening, wherein the support includes a supporting portion supported on a top surface of the top plate; a coupling portion coupled to the cabinet; and a connecting portion connecting the supporting portion to the coupling portion.

In still another embodiment, a built-in cooking appliance includes a cabinet having a depressed portion; a body frame received in the depressed portion; a top plate disposed above the body frame; a support provided on a corner of at least one side of the top plate, spaced apart from the cabinet, and connecting the top plate to the cabinet a top plate; and an airflow opening provided on the support.

Advantageous Effects

According to the embodiments, cooling efficiency of the cooking appliance can be improved. In addition, safety and convenience in using the cooking appliance can be improved.

BRIEF DESCRIPTION OF THE DRAWINGS

FIG. 1 is a perspective view of a built-in cooking appliance according to an embodiment, when a cooker is being installed.

FIG. 2 is a perspective view of the built-in cooking appliance of FIG. 1, when the cooker is completely installed.

FIG. 3 is a partly broken perspective view of the built-in cooking appliance of FIG. 1.

FIG. 4 is a sectional view taken along line I-I' of FIG. 2.

FIG. 5 is an enlarged view of a portion A of FIG. 4.

FIG. 6 is a partial sectional view of a built-in cooking appliance according to a second embodiment.

FIG. 7 is an enlarged view of a portion B of FIG. 6.

FIG. 8 is a partly broken perspective view of a built-in cooking appliance according to a third embodiment.

FIG. 9 is a perspective view of a top frame shown in FIG. 8.

FIG. 10 is a sectional view taken along line II-II' of FIG. 8.

FIG. 11 is a perspective view of a modified example of the top frame of the third embodiment.

BEST MODE FOR CARRYING OUT THE INVENTION

Reference will now be made in detail to the embodiments of the present disclosure, examples of which are illustrated in the accompanying drawings.

First Embodiment

FIG. 1 is a perspective view of a built-in cooking appliance according to an embodiment, when a cooker is being installed and FIG. 2 is a perspective view of the built-in cooking appliance of FIG. 1, when the cooker is completely installed.

Referring to FIGS. 1 and 2, a built-in cooking appliance of this embodiment includes a cabinet 1 installed in a kitchen, a depressed portion 2 formed on a surface of the cabinet 1, a water outlet 4 formed through a portion of the depressed portion 2 of the cabinet 1, a cooker 5 having a first portion received in the depressed portion 2 and a second portion seating on a top surface of the cabinet 1, and a top frame 6 for covering a space defined between the cooker 5 and the cabinet.

The depressed portion 2 is depressed by a predetermined depth from the top surface of the cabinet 1 to receive the first portion of the cooker 5.

The depressed portion 2 is smaller than a top surface of the cooker 5. Therefore, when the cooker 5 is received in the depressed portion 2, an edge portion of the cooker 5 seats on the top surface of the cabinet 1. In more detail, a top plate (51 in FIG. 3) provided on an upper end of the cooker 5 seats on the top surface of the cabinet 1.

Therefore, since the top plate 51 seats on the top surface of the cabinet 1, only the top plate 51 protrudes above the top surface of the cabinet 1. Therefore, the protruding height of the cooker 5 from the cabinet 1 can be minimized.

When the cooker 5 is installed on the cabinet 1, a rear end portion of the top plate 51 does not seat on the top surface of the cabinet 1. That is, since a space through which internal hot air of the cooker 5 is discharged must be formed between a rear end portion of the cooker 5 and the cabinet 1, the rear end portion of the top plate 51 does not seat on the top surface of the cabinet 1 but is spaced apart from the top surface of the cabinet 1. That is, if the rear end portion of the top plate 51 seats on the cabinet 1, no space through which the internal heat of the cooker 5 is formed. Therefore, the rear end portion of the top plate 51 must be spaced apart from the top surface of the cabinet 1.

At this point, the rear end portion of the top plate 51 is supported by a support 7 installed on the cabinet 1.

As the top plate 51 seats on the cabinet 1 as described above, a dishware can be stably set on the top surface of the top plate 51. In addition, since only the top plate 51 protrudes above the top surface of the cabinet 1, an outer appearance of the cooking appliance can be improved.

Meanwhile, although a bottom of the depressed portion 2 is closed, air may be introduced into the depressed portion 2 through other clearances of the cabinet and the introduced air may be directed into the cooker 5.

Further, the water outlet 4 may be formed right under a passage along which the water flows down from the cooker 5. If the bottom of the depressed portion 2 is inclined, the water outlet 4 is formed on a lowest portion of the inclined bottom of the depressed portion 2.

FIG. 3 is a partly broken perspective view of the built-in cooking appliance of FIG. 1, FIG. 4 is a sectional view taken along line I-I' of FIG. 2, and FIG. 5 is an enlarged view of a portion A of FIG. 4.

Referring to FIGS. 3 through 5, the cooker 5 includes a top plate 51 functioning as a support plate on which a dishware is located and a main body 52 disposed under the top plate 51.

An outer appearance of the main body 52 is defined by a body frame. A heater 54 for generating heat and a fan 53 for discharging the hot air out of the main body 52 are installed in the main body 52. Any types of heaters such as a direct heating type or an induction heating type may be used as the heater.

As described above, since front and side edge portions of the top plate 51 seat on the top surface of the cabinet 1, only the top plate 51 protrudes above the cabinet 1.

On the other hand, the rear edge portion of the top plate 51 is supported by the support 7 installed on the cabinet 1. In more detail, the support 7 has a first portion seating on the top surface of the cabinet 1 and coupled to the cabinet 1 and a second portion supporting the top surface of the top plate 1. At this point, the support 57 may be adhered to the under surface of the top plate 57. The support 57 may be screw-coupled to the cabinet 57.

Here, it may be understood that a space through which the hot air is discharged is eliminated by the support 7. However, in this embodiment, an air flow hole formed by the support 7 functions as the space.

The following will describe the support 7 in more detail.

The support 7 includes a supporting portion 72 supporting the rear edge portion of the top plate 51, a coupling portion 74 coupled to the cabinet 1, and a connecting portion 76 connecting the supporting portion 72 to the coupling portion 74.

The supporting portion 72 may be adhered to or screw-coupled to the top surface of the top plate to more securely fix its position.

The coupling portion 74 is coupled to the cabinet 1 in a state where it seats on the top surface of the cabinet 1. However, the coupling portion 74 may be coupled to a surface defining the depressed portion 2 of the cabinet 1.

The connecting portion 76 is formed in a O-shape to connect the supporting portion 72 to the coupling portion 74. A portion of the connecting portion 76 supports the top plate 51 by closely contacting a rear surface of the top plate 51. The connecting portion 76 is provided with an airflow hole 77 through which the hot air in the main body 1 can pass. The connecting portion 76 contacts top and side surfaces of the top plate 51. As the side surfaces of the top plate 51 are supported by the support 7, the leftward/rightward movement of the top plate 51 can be prevented.

Although the connecting portion 76 is not limited to a specific shape as long as it can support at least the rear surface of the top plate 51.

Meanwhile, the connecting portion 76 is covered by the top frame 6. In more detail, the top frame 6 has a first end seating on the top plate 51 and a second end fixed on the cabinet 1. The fixing of the top frame on the cabinet 1 may be realized by a variety of method such as an adhesive method, a screw coupling method, a hook fixing method, and the like. The adhesive method is preferable.

The top frame 6 is spaced apart from the support 7 but covers the support 7. A space through which the air can pass is defined between the top frame 6 and the support 7. In this case, the top frame 6 protrudes from the top surface of the top plate 51 by a predetermined height. Therefore, when the dishware slips rearward, it stops slipping by the top frame 6.

The top frame 6 is provided at a rear portion with an opening 61 through which the air introduced into the space through the airflow hole 77 can be discharged.

That is, the air discharged out of the main body 52 can be completely discharged out of the cabinet 1 through the airflow hole 77 and the opening 61.

At this point, the hot air is discharged rearward through the opening 61. Therefore, the opening 61 is not viewed by the user, the outer appearance is not deteriorated and accident that may be caused by the hot air discharged through the opening can be prevented.

The following will describe an airflow process for cooling the inside of the cooker 5.

First, when the fan 53 operates, cool air is introduced into the cooker 5. The cool air may be introduced through an air inlet formed on a bottom of the main body 52 aligned with the fan 53.

The cool air introduced through the air inlet 55 may be sucked through the clearance of the cabinet 1, which is formed on a front portion of the depressed portion 2. Needless to say, when the bottom of the depressed portion 2 is formed having an opening, the cool air may be sucked through the bottom of the depressed portion 2.

The air sucked by the fan 53 is discharged through an air outlet 56 formed on the rear portion of the main body 52 via a control unit (not shown) and the heater 54. The air discharged through the air outlet 56 is discharged to the external side through the airflow hole 75.

In order not to direct the air discharged through the air outlet 56 to other spaces in the depressed portion 2 but to the airflow hole 75, an airflow guide 65 may be further formed on a rear portion of the main body 1.

The following will describe relationship between fluid around the cooker 5 and this embodiment.

First, since the cooker 5 is installed in a place such as the kitchen where the water is frequently used, it must be considered to prevent the water from flowing into the cooker 5. To realize this, the bottom surface of the top plate 51 and the surface of the cabinet 1 are sealed together at front and both sides of the top plate 51 by a sealing member. Therefore, only the top frame 6 on which the opening 61 is formed is a weak point through which the external fluid may be introduced into the cooker 5.

That is, the water may be introduced into the cooker 5 through the opening 61. However, since the water introduced into the cooker 5 flows downward through the airflow hole 77 formed on the support 72, the water is not directed into the main body 52.

In more detail, the airflow hole 77 of the support 7 functions as a passage allowing the water introduced from the external side to flow downward without being introduced into the main body 52 while functioning as a passage along which the air discharged from the main body 52 flows.

The water flowing downward may be discharged to the external side through the water outlet 4 or vaporized by the heat generated by the cooker.

The following will describe a modified example of this embodiment.

First, when the depressed portion 2 is closed, the water outlet 4 functions to discharge the water collected in the depressed portion 2 to the external side. When the depressed portion 2 is not closed but opened, a water collecting unit may be provided under the depressed portion 2 to collect the water flowing downward from the cooker and discharge the collected water to the external side.

The top frame may be designed having a first side fixed on the cabinet 1 and a second side spaced apart from the top surface of the top plate. In this case, a front opening is defined between the top plate and the top frame so that the air can pass through the front opening.

In this case, since the air discharged from the space to the external side is divided into two ways, the airflow efficiency can be improved while the airflow resistance is reduced. Further, noise generated by the flowing air can be reduced.

Furthermore, the air discharged through the front opening can quickly dissipate the high heat of the top surface of the top plate while flowing along the top surface of the top plate. Therefore, as using the cooker, the heat remained on the top plate can be quickly dissipated. This enhances the safety in using the cooker.

Needless to say, when the cooker starts operating in a state where the dishware is located on the top plate, the air discharge through the front opening may dissipate the heat transmitted from the top plate to the dishware. In this case, since the top plate, however, closely contacts the dishware, the air cannot flows into the contact portion between the top plate and the dishware. Therefore, the heat dissipation problem is not serious. In addition, by designing the front opening and the rear opening with an optimal size ratio, the deterioration of the heat efficiency can be prevented while providing the safety in using the cooker.

Second Embodiment

A second embodiment is identical to the first embodiment except for a structure of the support. Therefore, like reference numerals denote like elements throughout the drawings of the first and second embodiments. Only different elements from the first embodiment will be described in this embodiment.

FIG. 6 is a partial sectional view of a built-in cooking appliance according to a second embodiment, and FIG. 7 is an enlarged view of a portion B of FIG. 6.

Referring to FIGS. 6 and 7, the support 7 has a first portion coupled to an inner surface of the cabinet 1 and a second portion supporting the top surface of the top plate 5. At this point, the top plate 51 may be directly adhered to the support 7. The coupling of the support 7 to the cabinet 1 may be realized by a screw.

The support 7 includes a support supporting a top-rear end portion of the top plate 51, a coupling portion 74 coupled to the cabinet 1, and a connecting portion 76 connecting the supporting portion 72 to the seating portion 74.

The supporting portion 72 may be adhered or screw-coupled to the top surface of the top plate 51. When the supporting portion 72 supports the top surface of the top plate 51, the protruding height of the cooker 5 may be reduced.

The coupling portion 74 is coupled to the inner surface of the cabinet, i.e., to an under surface of a protruding portion of the depressed portion 2. However, the coupling portion 74 may be coupled to any portion defining the depressed portion 2.

The connecting portion connects the supporting portion 72 to the coupling portion 74 while maintaining a predetermined space between a rear end portion of the top plate 51 and the inner surface of the cabinet 1. The connecting portion 76 is formed to face the rear surface of the top plate 51 and the inner surface of the cabinet 1. That is, the connecting portion 76 does not entirely contact the top plate 51 and the cabinet 1 to provide a space through which the inner hot air of the cooker 5 can be discharged to the external side through the airflow hole 77.

However, the connecting portion 76 may contact the side surface of the top plate 52. In this case, the rearward movement of the top plate can be limited by the support.

In this embodiment, even when the water flows through the opening g61 of the top frame, the flow of the water can be primarily stopped by the support and thus an amount of the water that can flow into the cooker can be reduced. Furthermore, as the support is coupled to the undersurface of the cabinet, i.e., to the under surface of the protruding portion of the cabinet, the coupling force can be enhanced.

Third Embodiment

In the first and second embodiments, a large air outlet is provided on the support or the top frame. In this case, the water may be introduced from the external side into the main body. This may cause the malfunction of the cooker. A third embodiment is proposed to solve the problem. Like reference numerals denote like elements throughout the drawings of the first, second, and third embodiments. Only different elements from the first and second embodiment will be described in this embodiment.

A top frame 210 is mounted above a space defined between a rear end of a top plate 200 and a rear end of a receiving portion 120 to cover the space. The top frame 210 is designed to discharge the hot air out of the main body 300 in a side direction rather than a rear direction.

FIG. 8 is a partly broken perspective view of a built-in cooking appliance according to a third embodiment and FIG. 9 is a perspective view of a top frame shown in FIG. 8.

Referring to FIGS. 8 and 9, the top frame 210 functions as a cover for covering a space defined between a rear corner of the top plate 200 and the cabinet 100. The top frame 210 includes a top panel 211 defining a top outer appearance, a bottom panel 212 defining a bottom outer appearance, a rear panel defining a rear outer appearance, and side panels 214 defining a side outer appearance.

The top panel 211 is formed of a rectangular panel having a predetermined thickness and extending in a horizontal direction. The rear panel 213 is formed by being bent at a rear end portion of the top panel 211. The rear panel 213 is inclined rearward as it goes downward.

The rear panel 213 is formed of a rectangular panel having a predetermined thickness and extending in a horizontal direction. The bottom panel 212 is formed by being bent frontward at a lower end portion of the rear panel 213.

The bottom panel 212 is formed of a rectangular panel having a predetermined thickness and extending in a horizontal direction. The bottom panel 212 is larger than the top panel 211.

The side panels 214 are disposed between the top and bottom panels 211 and 212. Each of the side panels 214 is formed of a rectangular plate having a predetermined thickness. A right surface of each of the side panels 214 is inclined rearward at it goes downward.

A front end portion of each of the side panels 214 is located behind front end portions of the top and bottom panels 211 and 213. A length of the top surface of the side panel 214 is less than a front-rear length of the top panel 211. A length of the bottom surface of the side panel 214 is less than a front-rear length of the bottom panel 212. In this state, when the rear surface of the side panel 214 is located on a same plane as the rear surface of the rear panel 213, the front end portion of the side panel 214 is located behind the front end potions of the top and bottom panels 211 and 213.

A distance between the under surface of the top panel 211 and the top surface of the bottom panel 212 corresponds to the thickness of the top plate 200. Therefore, a height of the side panel 214 is set to correspond to the thickness of the top plate 200. Furthermore, a left-right length of the top panel 211 and a left-right length of the bottom panel 212 are set to correspond to a left-right length of the top plate 200.

*The top frame has an opened front portion. The rear end portion of the top frame 210 is inserted into the top frame 210 through the opened front portion. When the top late 200 is inserted between the top and bottom panels 211 and 212, the front end of the top frame 210 supports an opposing surface of the top plate 200 and the front surfaces of the side panels 214 support the rear surface of the top plate 200.

As a feature of this embodiment, the bottom panel 212 of the top frame 210 is provided with a second air outlet 430 through which the hot air discharged through the first air outlet 330 is introduced into an inner space of the top frame 210. The hot air introduced into the top frame 210 through the second air outlet 430 is discharged through third air outlets 450 formed on the side panels 214.

By the above-described structure, the air is discharged to the external side through the air outlets formed on both side surfaces of the top frame 210. In this case, an area through which the water inflows from the external side is small. Therefore, the malfunctioning of the cooker, which is caused by the water, can be prevented.

FIG. 10 is a sectional view taken along line II-If of FIG. 8.

The following will describe operation of this third embodiment with reference to FIG. 10.

A first air outlet 330 is formed on the rear surface of the main body 300 to discharge the hot air generated by a heater 310 mounted in the main body 300 out of the main body 300.

The first air outlet 330 may be formed on both side surfaces, a front surface or an under surface of the main body 300. In this case, the air discharge efficiency, however, is deteriorated. Therefore, the first air outlet 330 is preferably formed on the rear surface of the main body 300. Alternatively, the first air outlet 330 may not be formed. In this case, a special passage is formed to discharge the hot air out of the main body.

As described above, when the first air outlet 330 is formed on the main body 300, the hot air generated in the main body 300 flows out of the main body 300, i.e., toward a space between the main body 300 and the cabinet, through the first air outlet 330.

The hot air flows toward the space between the rear surface of the main body 300 and the cabinet 100 flows upward by a convection current phenomenon. The air flowing upward is directed to the top frame 210.

Meanwhile, the top frame 210 is provided with a second air outlet 430 through which the air passing through the first air outlet 330 is directed into the top frame 210. Each of the side panels 214 defining the both side surfaces of the top frame 210 is provided with a third air outlet 450 so that the air can be discharged to the external side through the both side surfaces of the top frame 210.

The third air outlet 450 is formed behind a rear surface of the top plate 200 supported by a front end portion of the top frame 210. In addition, the second air outlet 430 may be formed in an oval shape a rectangular shape extending in a horizontal direction on each of the side panels 214.

FIG. 11 is a perspective view of a modified example of the top frame.

Referring to FIG. 11, the front-rear length of the side panel 214 is greater than front-rear lengths of the top and bottom panels 211 and 212. The left and right side surfaces of the top plate 200 are supported by the side panels 214. By this structure, the relative position between the top plate 200 and the top frame 210 can be accurately set.

The panels of the top frame 210 may be formed by independent members that are assembled with each other. Alternatively, the panels of the top frame 20 may be formed by processing a single member.

According to another modified example of the third embodiment, a second air outlet 430 is formed on the bottom panel 212 defining the bottom of the top frame 210. The second air outlet 430 may be formed in a rectangular shape or with slits formed on the bottom panel at a predetermined interval. Instead of forming the second air outlet, a special passage may be formed to direct the hot air into the top frame.

In the above-description, the third air outlet 450 is formed on each of the side panels 214. However, the present invention is not limited to this configuration. For example, the third air outlet 450 functioning to discharge the hot air out of the top frame 210 may be further formed on the rear panel 213 and/or the top panel 211 as well as the side panels 214. In this case, since the air outlet area increases, the hot air can be more effectively discharged. However, when the air outlet area increases, the area through which the water can be introduced also increases. The air outlet formed on the rear panel 213 and the top panel 211 is not formed on an entire area but at intervals. In this case, a process for making the top frame 210 is complicated. However, the hot air discharging efficiency is improved. That is, a relatively large amount of the hot air can be discharged within a limited time.

Alternatively, the side panels 214 may be formed further extending frontward and the third air outlet 450 is provided on an extending portion of each of the side panels 214 to increase an area of the third outlet 450. In this case, since the top plate and the cabinet are sealed together at the side surfaces, the water cannot flow into the main body. Therefore, no water is introduced into the main body through the side panels 214 while increasing an area through which the air is discharged. As a result, since the hot air can be effectively discharged and thus the safety in using the cooker can be enhanced. In this case, the third air outlet 450 can be provided at a location higher than the top surface of the cabinet 100. Therefore, the reliability for preventing the water from flowing into the main body 300 through the air outlet formed on the top frame 210 can be enhanced.

In the above-description, the top frame 210 is disposed along the top edge of the top plate 200. However, the present invention is not limited to this embodiment. For example, the top frame 210 may be installed on the front and both side edge portions of the top plate 200.

In addition, the top frame 210 located on the rear edge portion of the top plate 200 is formed such that a surface bent downward from the front end portion of the bottom panel 212 is coupled to the rear surface of the main body 300.

In the above-described embodiments, the air outlet formed on the top frame 210 keeps its opened state. However, the present invention is not limited to this configuration. For example, an air outlet cover for selectively opening and closing the air outlet may be provided. In this case, the outer appearance of the product may be deteriorated.

In addition, the third air outlet 450 of the third embodiment, which discharges the hot air through a side end portion of the top frame, may be applied to the first and second embodiments. Therefore, in the first and second embodiments, the third air outlet 450 may functions as the opening 61 or may be provided on an end portion in the length direction of the top frame 6 together with the opening 61 to discharge the hot air in the side direction. In this case, since an area through which the water is introduced can be reduced, the malfunctioning of the product can be prevented while more effectively discharging the air.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the built-in cooking appliance of the present invention, the hot air is effectively discharged out of the cooker and the top plate does not distinguishably protrude above the cabinet. Therefore, the outer appearance of the product can be improved and the safety in using the cooker can be enhanced. Furthermore, the damage of the components by the heat can be prevented and thus the reliability of the product can be improved.

In addition, the flowing of the water into the main body can be prevented and thus the damage of the product by the water can be prevented, thereby improving the reliability of the products.

The invention claimed is:

1. A built-in cooking appliance comprising:

a top plate;

a body frame provided under the top plate and receiving a heat source, the body frame having at least an air outlet;

a cabinet supporting the body frame and spaced apart from at least one side of the top plate;

a support having a first side connected to the cabinet and a second side supporting a top surface of the top plate;

a top frame covering a space between the top plate and the cabinet; and airflow openings formed on the support and the top frame, wherein the airflow openings are positioned rearward of the air outlet, and the air discharged from the air outlet flows to the airflow openings, after flowing through a space defined within the cabinet.

2. The built-in cooking appliance according to claim 1, wherein the support has a contact surface contacting a portion of a top surface of the top plate.

3. The built-in cooking appliance according to claim 2, wherein the contact surface is bonding surface.

4. The built-in cooking appliance according to claim 1, wherein a space is defined between the top frame and the support.

5. The built-in cooking appliance according to claim 1, wherein the support contacts rear side surfaces of the top plate.

6. The built-in cooking appliance according to claim 1, wherein the airflow opening of the top frame directs the air rearward.

7. The built-in cooking appliance according to claim 1, wherein the support is located on a top surface of a protruding portion of the cabinet.

8. The built-in cooking appliance according to claim 1, wherein the support is disposed on an under surface of a protruding portion of the cabinet.

9. The built-in cooking appliance according to claim 1, wherein the opening of the top frame is formed at a predetermined height from a surface of the cabinet.

10. The built-in cooking appliance according to claim 1, wherein an under surface of the top plate is located at a same horizontal plane as a top surface of the cabinet.

11. The built-in cooking appliance according to claim 1, wherein the top frame is disposed lengthwise along at least a portion of a side edge portion of the top plate and the opening is provided on an end in a length direction of the top frame.

12. The built-in cooking appliance according to claim 1, wherein the support is formed of a plate.

13. A built-in cooking appliance comprising:

a body frame receiving a heat source, the body frame having at least an air outlet;

a top plate provided above the body frame;

a cabinet supporting the top plate; and a support connecting the top plate to the cabinet and provided with an airflow opening, wherein the support comprises:

a supporting portion supported on a top surface of the top plate;

a coupling portion coupled to the cabinet; and a connecting portion connecting the supporting portion to the coupling portion, wherein the air outlet and the airflow opening are communicated with a space defined within the cabinet, respectively, and the air discharged from the air outlet flows to the airflow openings, after flowing through a space defined within the cabinet.

14. The built-in cooking appliance according to claim 13, wherein the supporting portion closely contacts the top surface of the top plate.

15. The built-in cooking appliance according to claim 13, wherein the supporting portion is adhered to the top surface of the top plate.

16. The built-in cooking appliance according to claim 13, wherein the connecting portion is disposed at a side of the top plate.

17. The built-in cooking appliance according to claim 16, wherein the connecting portion contacts the side surface of the top plate or not.

18. The built-in cooking appliance according to claim 13, further comprising a top frame that extends in a direction to guide the air discharged from the opening, wherein the top frame is further provided at opposite end portions with openings.

19. A built-in cooking appliance comprising:

a cabinet having a depressed portion;

a body frame received in the depressed portion, the body frame having at least an air outlet;

a top plate disposed above the body frame;

a support provided on a corner of at least one side of the top plate, the at least one side of the top plate being spaced apart from the cabinet, and the support connecting the top plate to the cabinet a top plate; and an airflow opening provided on the support so as to allow the air inside of the body frame flows, wherein the support disposed on the upper surface of the top plate, and wherein the air discharged from the air outlet flows to the airflow openings, after flowing through a space defined within the cabinet.

20. The built-in cooking appliance according to claim 19, wherein the support is formed of a plate and an under surface of the support contacts a top surface of the top plate.

21. The built-in cooking appliance according to claim 19, wherein the support functions as a cover covering a space defined between the top plate and the cabinet and is provided at one or both of opposite ends with an air outlet.

* * * * *